US009222184B2

(12) United States Patent
Dufresne

(10) Patent No.: US 9,222,184 B2
(45) Date of Patent: Dec. 29, 2015

(54) CONTACT BAR WITH MULTIPLE SUPPORT SURFACES AND INSULATING CAPPING BOARD

(75) Inventor: Robert P. Dufresne, Quebec (CA)

(73) Assignee: PULTRUSION TECHNIQUE INC., Saint-Bruno (Quebec) (CA)

( * ) Notice: Subject to any disclaimer, the term of this patent is extended or adjusted under 35 U.S.C. 154(b) by 156 days.

(21) Appl. No.: 14/009,145

(22) PCT Filed: Mar. 29, 2012

(86) PCT No.: PCT/CA2012/050201

§ 371 (c)(1), (2), (4) Date: Oct. 1, 2013

(87) PCT Pub. No.: WO2012/129700

PCT Pub. Date: Oct. 4, 2012

(65) Prior Publication Data

US 2014/0183057 A1 Jul. 3, 2014

Related U.S. Application Data

(60) Provisional application No. 61/470,664, filed on Apr. 1, 2011.

(51) Int. Cl.
*C25C 7/00* (2006.01)
*C25C 7/02* (2006.01)

(52) U.S. Cl.
CPC .... *C25C 7/02* (2013.01); *C25C 7/00* (2013.01)

(58) Field of Classification Search
None
See application file for complete search history.

(56) References Cited

U.S. PATENT DOCUMENTS

| | | | | |
|---|---|---|---|---|
| 4,035,280 | A | 7/1977 | Deane et al. | |
| 4,213,845 | A | 7/1980 | Masada | |
| 4,479,863 | A * | 10/1984 | Honey et al. | 204/279 |
| 5,645,701 | A | 7/1997 | Dufresne et al. | |
| 2009/0152124 | A1 * | 6/2009 | Ashford et al. | 205/574 |
| 2012/0205254 | A1 * | 8/2012 | Navarro et al. | 205/560 |

FOREIGN PATENT DOCUMENTS

| | | | |
|---|---|---|---|
| CA | 1102737 | A1 | 6/1981 |
| CA | 2171412 | C | 2/2007 |
| CA | 2705247 | C | 5/2012 |
| EP | 0121509 | B1 | 6/1987 |

OTHER PUBLICATIONS

"Frustoconical." Merriam-Webster.com. Accessed Apr. 30, 2015. http://www.merriam-webster.com/dictionary/frustoconical.*

* cited by examiner

*Primary Examiner* — Harry D Wilkins, III
(74) *Attorney, Agent, or Firm* — Baker & Hostetler LLP

(57) ABSTRACT

The present invention related to a contact bar or contact bar segment, a contact bar and insulating capping board assembly and a method for operating an electrolytic cell including electrodes for refining metal. Embodiments of the contact bar include support sections with multiple support surfaces for lying against the insulating capping board, thereby distributing weight of the electrodes hanging on the contact bar; and contact sections for receiving the electrodes while providing good electrical contact and precise positioning thereof. While following the steps of the method for operating the electrolytic cell, lifetime of the contact bar and insulating capping board may be increased.

36 Claims, 18 Drawing Sheets

Prior Art

Prior Art

CONTACT BAR WITH MULTIPLE SUPPORT SURFACES AND INSULATING CAPPING BOARD

This application is a National Stage Application of International Application No. PCT/CA2012/050201 , filed Mar. 29, 2012 , entitled "CONTACT BAR WITH MULTIPLE SUPPORT SURFACES AND INSULATING CAPPING BOARD which claims priority to U.S. Provisional Patent Application No. 61/470,664 , filed on Apr. 1, 2011 , entitled, "Contact Bar with Multiple Support Surfaces", which is incorporated herein by reference in its entirety.

FIELD OF THE INVENTION

The present invention relates to a contact bar, and more specifically to a contact bar having multiple support surfaces. The present invention further related to a contact bar and capping board assembly and a related method of operating an electrolytic cell for refining metal.

BACKGROUND OF THE INVENTION

In the hydrometallurgical industry, it is of common practice to refine metal by electrolysis in electrolytic cells especially designed for this purpose. The metals to be refined are usually conventional metals such as copper, zinc, nickel or cadmium, or precious metals such as silver, platinum or gold, and others.

It is also of common practice to use metal plates as anodes or cathodes or both. These metal plates often weight several hundred pounds. Usually, the metal to be refined, or the metal used to carry the electric current, is in the form of plates of a given thickness, which are provided at their upper end with two laterally extending projections, called hanging bars. Such projections facilitate gripping, handling and hanging of the plates on lateral sidewalls of the cells. These projections also serve to electrically contact or insulate the electrode.

In use, the plates which, as mentioned, can each weight several hundred pounds, are immersed into the cells in parallel relationship and are used as anodes, cathodes or both, depending on the affinity of the metal being refined.

In order to have the electrodes positioned in a precise desired location, it is of common practice to place a member called a "capping board" or a "bus bar insulator" onto the top surface of each lateral sidewall of the cells. These capping boards are used to position the plates with respect to each other. They are also used as electric insulators between adjacent cells and/or the electrodes and/or the ground.

In practice, the capping boards are used not only as supports to position the electrodes, but also as supports to avoid damage to the masonry, concrete or polymer-concrete forming the lateral side walls of the cells during the insertion and removal of the heaving electrodes. They are also used for electrolytic refining and electrowinning of metals.

As examples of such capping boards and the way they can be manufactured, reference can be made to U.S. Pat. No. 4,213,842 and Canadian patent No. 1,102,737 . Reference can also be made to the U.S. Pat. No. 5,645,701 and Canadian patent No. 2,171,412.

The above-mentioned insulating capping boards are used to hold the electrodes at very precise positions. They are also used in combination with electrically conductive contact bars the purpose of which is to allow electrical connection between the ends of the anodes and cathodes located in adjacent cells. Thus, the combined use of capping boards and contact bars has the particularity of allowing both insulation and distribution of electric current.

To achieve proper electrical contact with the contact bar, the plates forming the electrodes are provided with support hanging legs externally projecting on their opposite upper ends. Only one end of the legs of each plate is in contact with a contact bar on one side of the cell where it is located. The other leg of the same plate is held onto the capping board located on the opposite side of the cell in such a way as to be insulated. Thus, the capping board per se plays the role of an insulator and is thus made of insulating material. The contact bar usually extends over the full length of the corresponding capping board in order to connect altogether all the anodes of one cell to all the cathodes of the adjacent cell and vice versa. The contact bar may interconnect all of the cathodes to the anodes on other adjacent cells or perform other electric connection function between electrodes as desired.

There are a few known types of contact bar, each of which has disadvantages and associated challenges.

One typical type of contact bar is of triangular cross-section. The triangular contact bar sits within a seat of a capping board and has three edges and three surfaces which can be sequentially used to provide the electrical connection. The triangular contact bar can thus essentially be used three times, through changing the orientation, which is quite onerous. It contacts the insulator in such a way that causes little compression on the insulator supporting the load of the contact bars and electrodes. However, the electric contact quality is mediocre and can rapidly decrease due to marks, holes and bumps that it may receive on the edge during manipulation of the electrodes. The electrical contact is also substantially linear and thus when the contact bar becomes even slightly warped or bumpy, the quality of electrical contact becomes very poor because of decreased surface contact. This poor contact situation also generates heat which over time damages the insulator. Such heat generation decreases electric current efficiencies and increases operating costs.

Another type is the rectangular or trapezoidal contact bar, which is similar to the triangular contact bar but has a generally rectangular cross-section which rounded corners and a moderately curvilinear side (as seen in FIG. 4, Prior Art). This type of contact bar can be used two times. Like the triangular contact bars, the rectangular contact bars causes little compression on the insulator supporting the load of the contact bars and electrodes, but has similar problems and disadvantages as the triangular type as discussed above.

Another type is the so-called "spool" contact bar which is described is U.S. Pat. No. 4,035,280 (as seen also in FIGS. 1 to 3, Prior Art). The spool contact bar can be used multiple times before changing it and provides excellent electrical contact. To maintain good electrical contact, the spool can simply be rotated. To prevent it from displacing or rolling, it must be retained often by using a V-shaped or notched piece and the retention systems are often complicated and result in certain disadvantages. The spool contact bar may lie on and contact a notched portion of header bars and the weight of the electrodes ensures high pressure contact between the notched header bars and points located on the sidewalls of the spool contact bar. However, the high pressure results in premature wearing and damage to the insulators and replacing insulators is very costly and onerous.

Another type is the so-called "dog bone" contact bar, which has an elongated plate like portion with parallel elevated projections along the length of the contact bar. Some so-called dog bones are continuous and/or have a series of teeth-like projections running along either edge of the plate portion. This kind of contact bar has advantages in terms of handling the electrodes, due to symmetrical hanging legs of the electrodes. This contact system also has similar disadvantages as the triangular contact bar, i.e. wearing, notching and corroding of the triangle edge of the contact and has other disadvantages such as accumulating acid mist which creates corrosion of the contact bar and the insulator. Replacement of the so-called 'dog bone' is very difficult and it is also costly to manufacture and has other disadvantages.

There is indeed a need in the industry for a contact bar and capping board technology that would overcome at least some of the aforementioned disadvantages and challenges.

SUMMARY OF THE INVENTION

The present invention responds to the above-mentioned need by providing a contact bar or contact bar segment with multiple support surfaces, a contact bar and capping board assembly and a related method for operating an electrolytic cell.

In one aspect of the present invention, there is provided a contact bar segment for use in an electrolytic cell for resting on an insulating capping board and contacting electrodes to provide electrical contact therewith. The contact bar includes a plurality of support sections comprising multiple support surfaces for resting on the insulating capping board and distributing weight. The contact bar also includes a plurality of contact sections in an alternate configuration with the support sections. The contact sections define recesses for receiving corresponding electrodes and providing electrical contact therewith.

According to an optional aspect of the contact bar segment, each support section may have a cross-sectional shape chosen so as to provide a number of support surfaces between 3 and 10 . The number of support surfaces in each support section may be 4, 6 or 8.

According to another optional aspect of the contact bar segment, the cross-sectional shape of each support section may be square, rectangular, pentagonal, hexagonal, heptagonal, octagonal, nonagonal or decagonal.

According to another optional aspect of the contact bar segment, at least one support surface of each support section may be contacting the insulating capping board for providing support to the contact bar segment.

According to another optional aspect of the contact bar segment, each contact section may comprise two opposed side portions for contacting the electrode and a central portion located in between the two side portions to form the recesses in the contact bar segment.

According to another optional aspect of the contact bar segment, each side portion may be tapered from proximate the support section inwardly toward the central portion of the contact section. Each side portion may be frusto-conical and extend from proximate the support surfaces of the adjacent support section to the central portion.

According to another optional aspect of the contact bar segment, the multiple support surfaces may have a size which corresponds to a weight of the electrodes hanging on the contact bar segment. Optionally, the multiple support surfaces may have a size which is proportional to the weight of the electrodes hanging on the contact bar segment.

According to another optional aspect of the contact bar segment, the support sections may comprise bevelled corners between each of the multiple support surfaces for facilitating rotation of the contact bar segment with respect to the insulating capping board.

According to another optional aspect of the contact bar segment, the central portions may comprise two opposed end central portions located at respective extremities of the contact bar segment and a plurality of inner central portions, each inner central portion being located in between two support sections of the contact bar segment. Optionally, each end central portion may be terminated by an end wall, the end wall having an edge contacting the insulating capping board. The end wall may have a cross-sectional shape which is similar to the one of the support sections.

According to another optional aspect of the contact bar segment, each of the two opposed end central portions comprises at least one planar surface which is configured to rest on the insulating capping board for improving the distribution of a pressure exerted by the electrodes on the capping board. Optionally, each of the two opposed end central portions has a square or rectangular cross-sectional shape. The two opposed end central portions and the inner central portions may also have a square or rectangular cross-sectional shape.

According to another optional aspect of the contact bar segment, the contact bar segment may be a one-piece structure.

According to another optional aspect of the contact bar segment, the contact bar segment may be a first contact bar segment of multiple similar adjacent contact bar segments positionable in non-electrical contact relation with respect to one another so as to form a contact bar resting along the insulating capping board.

According to another optional aspect of the contact bar segment, each contact bar segment is spaced apart from an adjacent contact bar segment by a space for ensuring insulation.

According to another optional aspect of the contact bar segment, each contact bar segment comprises a hollow passage threaded along a length of the contact bar segment. The hollow passage may have an octagonal cross-sectional shape.

According to another optional aspect of the contact bar segment, there may be provided an insulating rod located in the hollow passage of the contact bar segment for structurally joining together the multiple adjacent contact bar segments.

According to another optional aspect of the contact bar segment, the contact bar segment may have a length extending all along the insulating capping board so as to form a contact bar resting along the insulating capping board.

In another aspect of the present invention, there is provided a contact bar and capping board assembly for use in an electrolytic cell. The assembly includes an insulating capping board and at least one contact bar positionable along the central elongated channel. The insulating capping board includes two opposed rows of support seats in spaced apart relationship to each other for defining a central elongated channel, each support seat defining a recess for enabling an electrode to rest thereon. The at least one contact bar includes a plurality of support sections including multiple support surfaces for resting on the capping board and distributing weight; and a plurality of contact sections in an alternate configuration with the support sections, each contact section including a recess for receiving another electrode and providing electrical contact therewith.

According to an optional aspect of the contact bar and capping board assembly, each support section may have a cross-sectional shape chosen so as to provide a number of support surfaces between 3 and 10 . Optionally, the number of support surfaces in each support section may be 4, 6 or 8.

According to another optional aspect of the contact bar and capping board assembly, at least one support surface of the multiple support surfaces of each support section may be in contact with the insulating capping board for providing support to the at least one contact bar.

According to another optional aspect of the contact bar and capping board assembly, at least one support surface of the multiple support surfaces of each support section may be in contact with the insulating capping board for providing support to the at least one contact bar.

According to another optional aspect of the contact bar and capping board assembly, each contact section may include two opposed side portions and a central portion located in between the side portions. Each side portion may be frusto-conical and extending from proximate the support surfaces to the central portion for defining a frusto-V-shaped recess for contacting the corresponding electrode.

According to another optional aspect of the contact bar and capping board assembly, each of the two opposed end central portions may include at least one planar surface which is configured to rest on the insulating capping board for improving the distribution of a pressure exerted by each electrode on the capping board.

According to another optional aspect of the contact bar and capping board assembly, each of the two opposed central portions may have a square or rectangular cross-sectional shape.

According to another optional aspect of the contact bar and capping board assembly, the insulating capping board may include a plurality of seats sized and configured for supporting the at least one planar surface of the two opposed end central portions and at least one inner central portion resting thereon.

According to another optional aspect of the contact bar and capping board assembly, the central elongated channel of the insulating capping board may be sized and shaped so as to contact inner side surfaces of the support seats of the capping board with side facing or vertical support surfaces of the at least one contact bar.

According to another optional aspect of the contact bar and capping board assembly, the capping board may include two opposed rows of support walls projecting upwardly from the central elongated channel for supporting side facing or vertical support surfaces of the at least one contact bar.

According to another optional aspect of the contact bar and capping board assembly, the at least one contact bar may be a first contact bar segment of multiple similar adjacent contact bar segments positionable in non-electrical contact relation with respect to one another.

According to another optional aspect of the contact bar and capping board assembly, each contact bar segment may include a hollow passage centrally threaded along a length of the contact bar segment.

According to another optional aspect of the contact bar and capping board assembly, there may be provided an insulating rod located into the hollow passage for structurally joining together the multiple contact bar segments while ensuring insulation therebetween.

According to another optional aspect of the contact bar and capping board assembly, the insulating capping board may include spacing walls projecting upwardly from the central elongated channel for spacing the multiple adjacent contact bar segments resting along the central elongated channel of the capping board.

In another aspect of the present invention, there is provided an a contact bar and capping board assembly including a plurality of adjacent contact bar segments, each contact bar segment being as defined above. The assembly also includes an insulating capping board having two opposed rows of support walls for laterally supporting side facing or vertical surfaces of the support sections of each contact bar segment, and two opposed rows of support seats, each support seat defining a recess for enabling a hanging bar of an electrode to rest thereon.

In another aspect of the present invention, there is provided a contact bar and capping board assembly for use in an electrolytic cell. The assembly includes a contact bar as defined above. The assembly also includes a capping board having two opposed rows of support walls for laterally supporting side facing or vertical surfaces of the support sections of the contact bar; and two opposed rows of support seats, each support seat defining a recess for enabling a hanging bar of an electrode to rest thereon.

In another aspect of the present invention, there is provided a method for operating an electrolytic cell including electrodes for refining metal. The method includes the steps of:

(a) providing a contact bar and capping board assembly as defined above, a first support surface of each support section of the contact bar resting on the insulating capping board;

(b) positioning each electrode so as to span an electrolytic chamber of the cell and such that two opposed hanging bars of each electrode rest respectively on one of the contact sections on one side of the chamber and a part of the insulating capping board on an opposed side of the chamber, the electrodes being provided in an alternating arrangement along the electrolytic cell;

(c) transmitting electrical current to the contact bar and the electrodes hanging thereon for refining the metal; and (d) after a period of time, rotating the contact bar such that a second support surface adjacent to the first support surface is resting on the capping board, the first support surface thereby no longer resting on the insulating capping board.

According to an optional aspect of the method, the rotating of step (d) may include lifting the hanging bars of the electrodes during rotation of the contact bar.

According to another optional aspect of the method, the rotating of step (d) may be performed when electrical contact between at least one of the contact sections and a corresponding one of the electrodes is reduced or prevented.

According to another optional aspect of the method, the method may also include repeating the rotating of step (d) a number of times in accordance with a number of the support surfaces of each support section of the contact bar.

According to another optional aspect of the method, the rotating of step (d) may be performed four times in accordance with a square cross-sectional shape of each support section of the contact bar.

According to another optional aspect of the method, the rotating of step (d) may be performed six times in accordance with a hexagonal cross-sectional shape of each support section of the contact bar.

According to another optional aspect of the method, the contact bar may be one contact bar segment of multiple similar contact bar segments and the rotating of step (d) may be performed on at least one contact bar segment without rotating other contact bar segments.

According to another optional aspect of the method, the method may include replacing at least one contact bar segment while leaving other contact bar segments on the capping board.

Embodiments of the contact bar or contact bar segment provide flat support surfaces for lying against insulating capping boards which distributes weight while also allowing contact sections for receiving the electrodes, which provides both a large surface area for protecting the capping board and good electrical contact with the electrodes. The contact bars may be used multiple times before replacement by rotation to contact another of the support surfaces of the support sections. The contact bar or contact bar segment may also provide precise positioning of the electrodes hanging thereon. This construction provides a long lifetime for the contact bar with long term excellent electric contact, while the insulating capping board provides electric insulation.

It should be understood that any one of the above mentioned optional aspects of the contact bar (or contact bar segment) and capping board may be combined with any other of the aspects thereof, unless two aspects clearly cannot be combined due to their mutually exclusivity. For example, the various geometries and configurations of the contact bar (or contact bar segment) described herein-above, herein-below and/or in the appended Figures, may be combined with any of the capping board, and contact bar and capping board assembly descriptions appearing herein and/or in accordance with the appended claims.

BRIEF DESCRIPTION OF THE DRAWINGS

Embodiments of the contact bar and capping board according to the present invention are represented in and will be further understood in connection with the following figures.

While the invention will be described in conjunction with example embodiments, it will be understood that it is not intended to limit the scope of the invention to these embodiments. On the contrary, it is intended to cover all alternatives, modifications and equivalents as may be included as defined by the appended claims. The objects, advantages and other features of the present invention will become more apparent and be better understood upon reading of the following non-restrictive description of the invention, given with reference to the accompanying drawings.

DETAILED DESCRIPTION

The present invention is directed to a contact bar and capping board for use in an electrolytic apparatus including electrolytic cells for refining metal. The present invention is further directed to a method for operating electrolytic cells including a contact bar and capping board assembly.

It is worth mentioning that throughout the following description, when the article "a" is used to introduce an element, it does not have the meaning of "only one" it rather means of "one or more". For instance, the assembly of a contact bar and a capping board according to the present invention may be provided with one or more contact bar (also referred herein after as contact bar segments), one or more capping board, etc. without departing from the scope of the present invention.

It also worth mentioning that throughout the following description, when referring to a contact bar, it may also refer to a contact bar segment and vice-versa without departing from the scope of the present invention, unless aspects of the contact bar segment clearly cannot be combined to ones of the contact bar due to their exclusivity.

Figure 1:
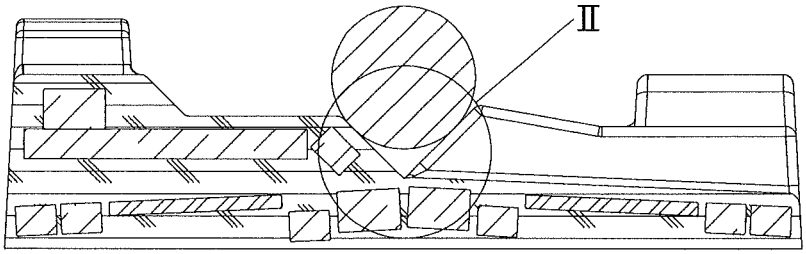
FIG. 1 Prior Art
FIG. 1 is a plan cut cross-sectional view of a known spool contact bar mounted in a V-shaped insulator.
Figure 2:
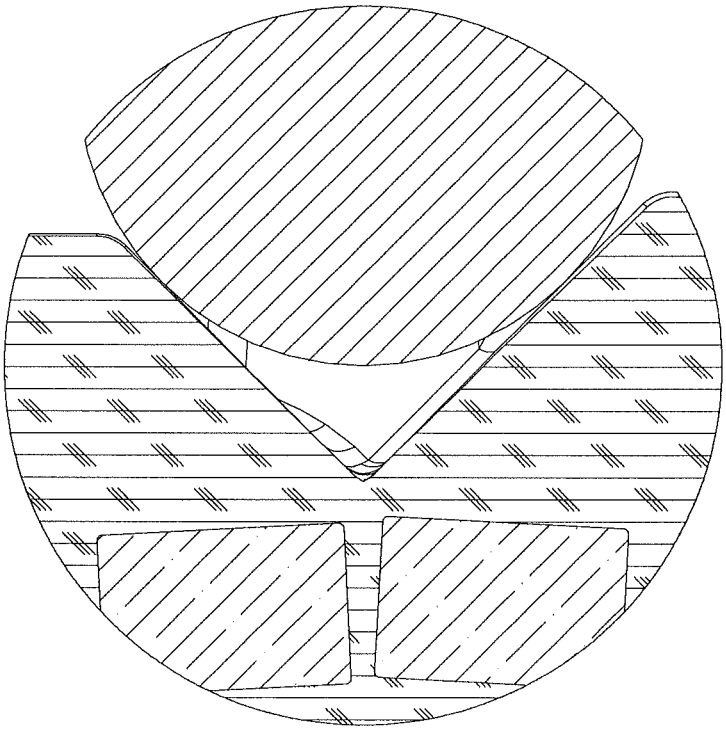
FIG. 2 is a close-up view of area II of FIG. 1.
Figure 3:
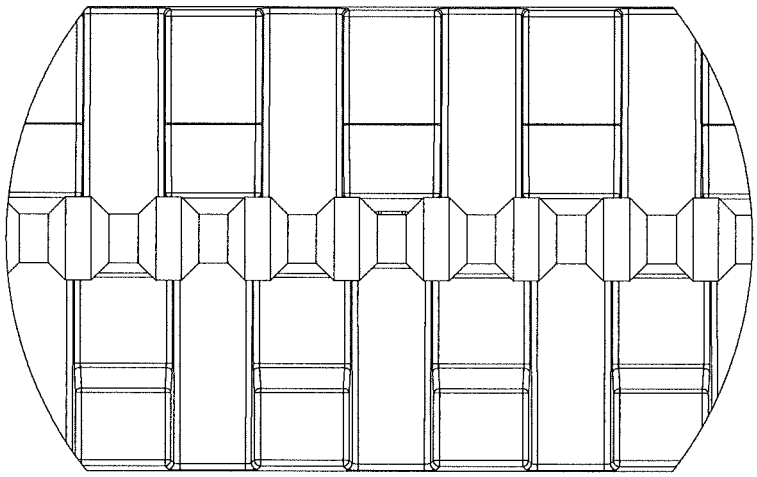
FIG. 3 is a top plan view of part of a known spool contact bar mounted on a V-shape insulator.
Figure 4:
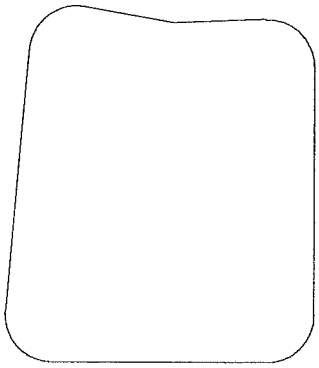
FIG. 4 is a plan cross-sectional view of a known trapezoidal contact bar.
Figure 5:
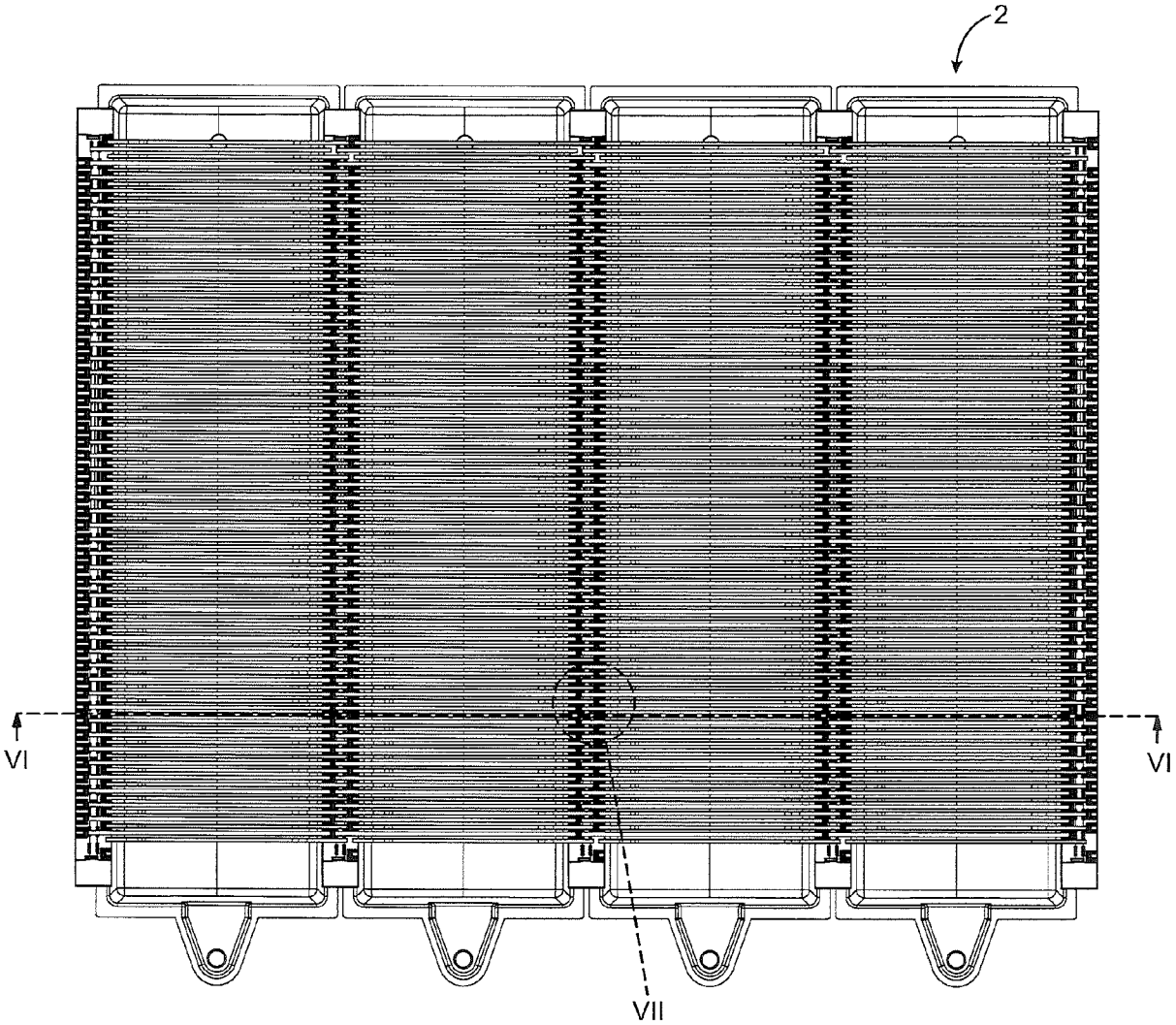
FIG. 5 is a top plan view of a part of an electrolytic cell including a contact bar, capping board and electrodes, according to an embodiment of the present invention.
Figure 6:
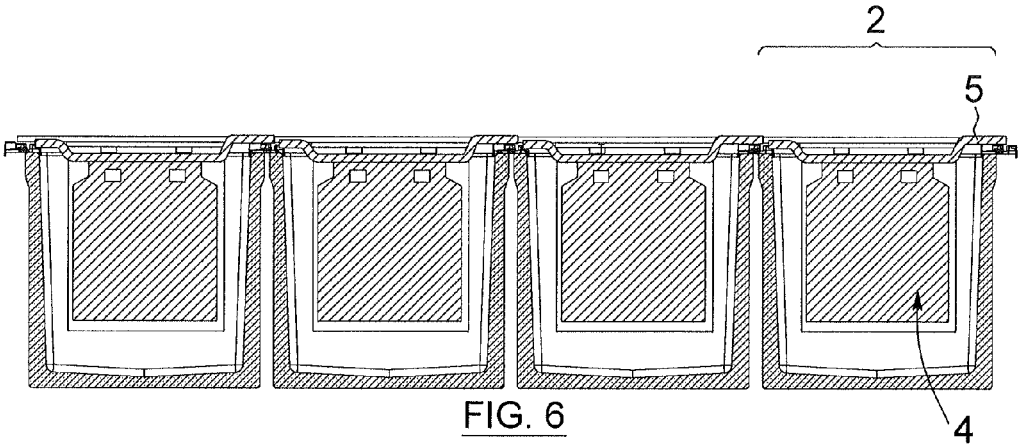
FIG. 6 is cross-sectional view along line VI of FIG. 5.

Referring to FIG. 5, the electrolytic apparatus for refining metals includes a plurality of electrolytic cells 2 wherein electrodes, more particularly anodes and cathodes, are alternately disposed within each electrolytic cell so as to refine metals. Also referring to FIG. 6, each electrode 4 is mounted onto a hanging bar 5 so as to be hanged within a vessel of the electrolytic cell 2. Further referring to FIG. 7, hanging bars 5 are alternatively resting on a capping board 8 and contacting a contact bar segment 7 which lays on the capping board 8. The capping board 8 is therefore intended to be used to support the hanging bars 5 of anodes and cathodes mounted within adjacent electrolytic cells. The capping board 8 may include a main body having a bottom surface shaped to fit onto upper edges of two adjacent electrolytic cells. The contact bar may be an integral mono-piece extending the entire length of the capping board 8. The capping board 8 prevents the hanging bar 5 resting thereon from receiving electrical current. On the contrary, the contact bar is made of a conductive material which transfer electrical current to the hanging bar 5, and consequently to the electrode. Optionally, a plurality of contact bar segments configured in spaced relationship to one another, may be used in place of the one-piece structure contact bar.

According to an optional aspect, the contact bar may extend over the entire length of the capping board for the purpose of allowing connection of the anodes located in one electrolytic cell to the cathodes located in the adjacent electrolysis cell, via their respective hanging bars that stay directly on it.

Figure 8:
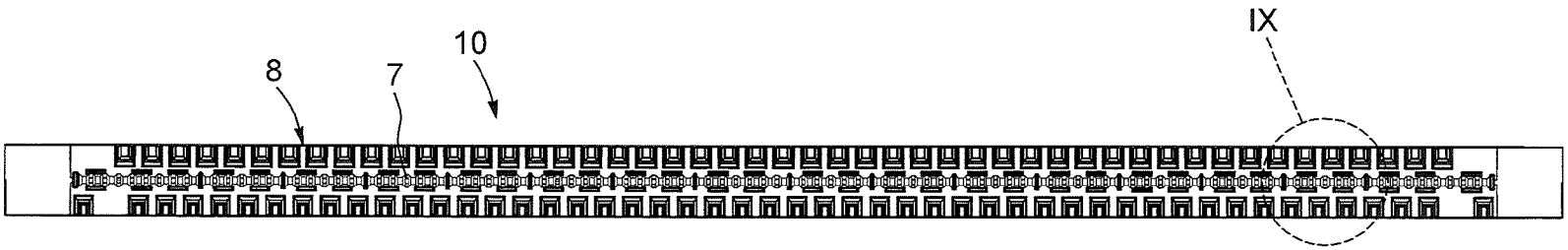
FIG. 8 is a top plan view of a contact bar and capping board assembly according to another embodiment of the present invention.
Figure 10:
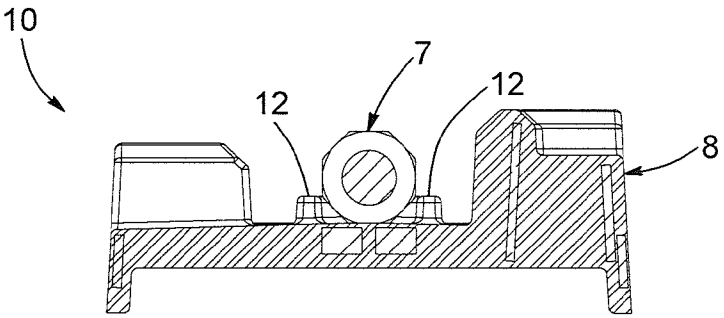
FIG. 10 is a cross-sectional view along line X of FIG. 9.

FIG. 8 is a top plan view of the capping board 8 and contact bar segments 7 assembly 10 isolated from the previously described electrolytic cell according to an optional aspect of the present invention.

Figure 12:
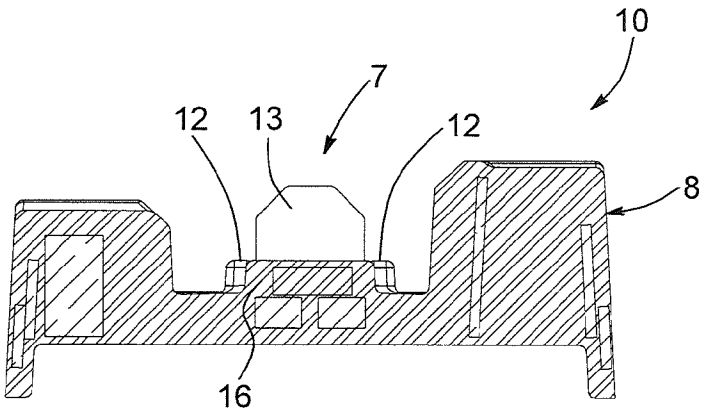
FIG. 12 is a cross-sectional view along line XII of FIG. 9.
Figure 11:
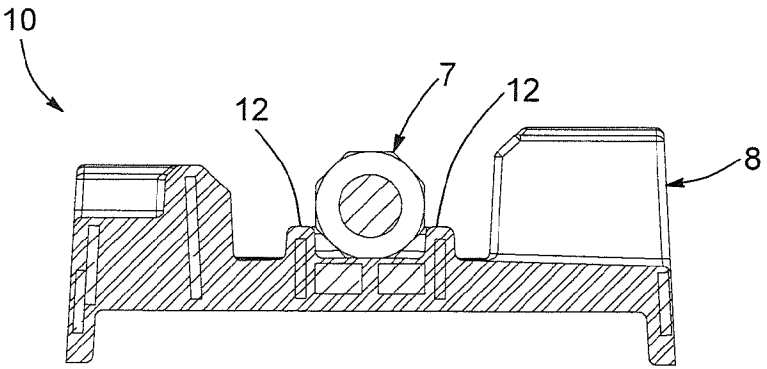
FIG. 11 is a cross-sectional view along line XI of FIG. 9.
Figure 13:
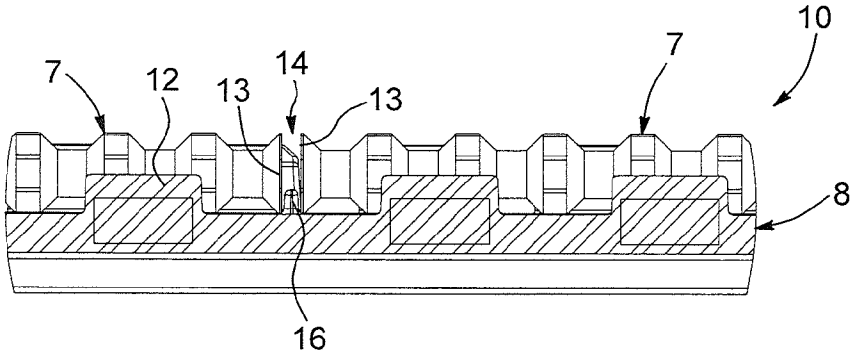
FIG. 13 is a cross-sectional view along line XIII of FIG. 9.

As better seen in FIGS. 9 to 13, the capping board 8 includes two opposed rows of support walls 12 configured to aid retention of the contact bar segments 7 (or contact bar). The two rows of support walls 12 may be spaced apart from each other in accordance with the desired lateral support effect and the shape, size and configuration of the contact bar segments 7. In the configuration illustrated in FIGS. 9 to 13, each contact bar segment 7 is separated from an adjacent segment 7 by a space 14 which may be sized to allow no electric contact between the adjacent contact bar segments 7. Referring to FIGS. 12 and 13, each contact bar segment 7 includes an end wall 13 at its two extremities. Each contact bar segment 7 therefore includes two opposed end walls 13. These contact bar segments have the advantage of limiting the spread of an electrical short-circuit that may occur thanks to the spaces between segments. As better shown in FIGS. 12 and 13, the capping board 8 further includes spacing walls 16 in between two adjacent end walls 13 to maintain the contact bar segments 7 in spaced relationship (defined by space 14) to each other, and ensure electric insulation therebetween. It should be understood that the support walls and spacing walls may have a variety of configurations and constructions depending on the shape and arrangement of the contact bar or contact bar segments.

Another advantage of the contact bar segments is that, during maintenance operations or replacement a contact bar segment, an operator only has to lift one part of the hanging bars of the electrodes at a time instead of all hanging bars of the electrolytic cell. In case of a one-piece contact bar construction, one must wait until the cell is empty of electrodes for maintenance operations.

Figure 9:
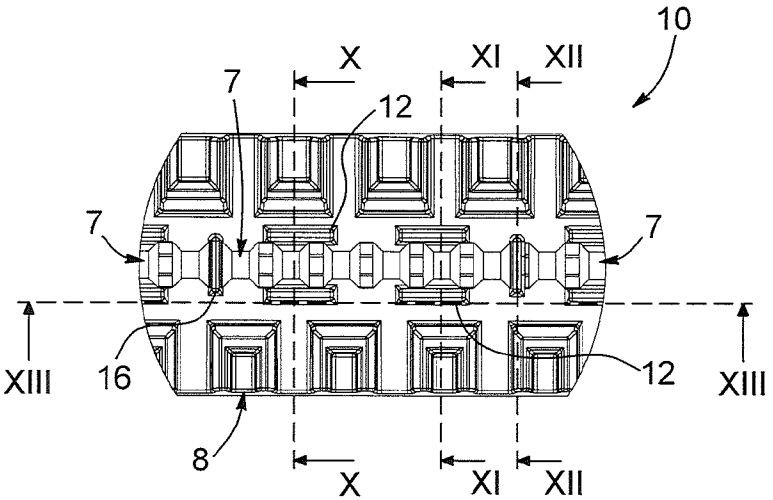
FIG. 9 is a close-up view of area IX of FIG. 8.
Figure 14:
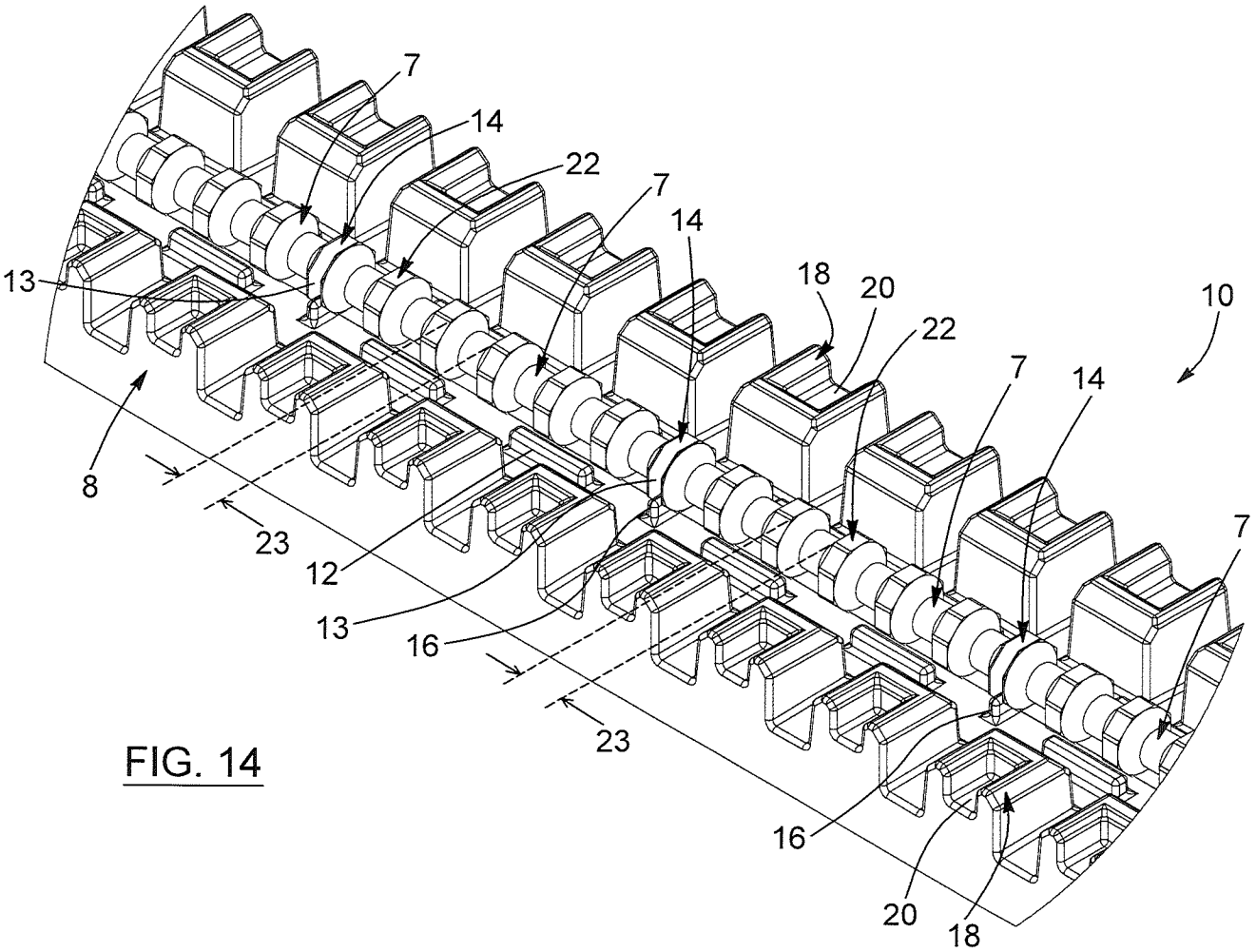
FIG. 14 is a top perspective view of a part of a contact bar and capping board assembly according to an embodiment of the present invention.
Figure 20:
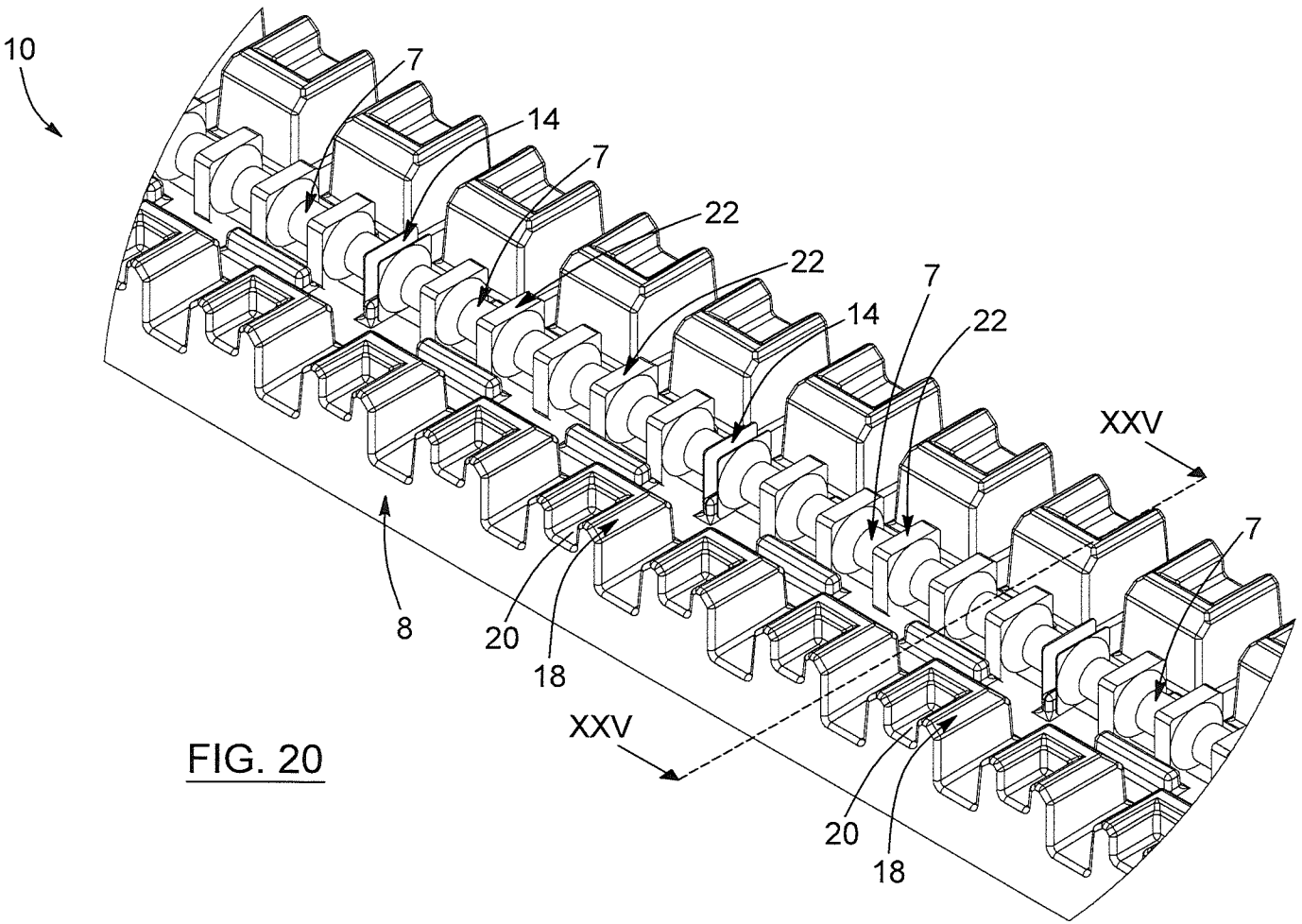
FIG. 20 is a top perspective view of a part of a contact bar and capping board assembly according to another embodiment of the present invention.
Figure 21:
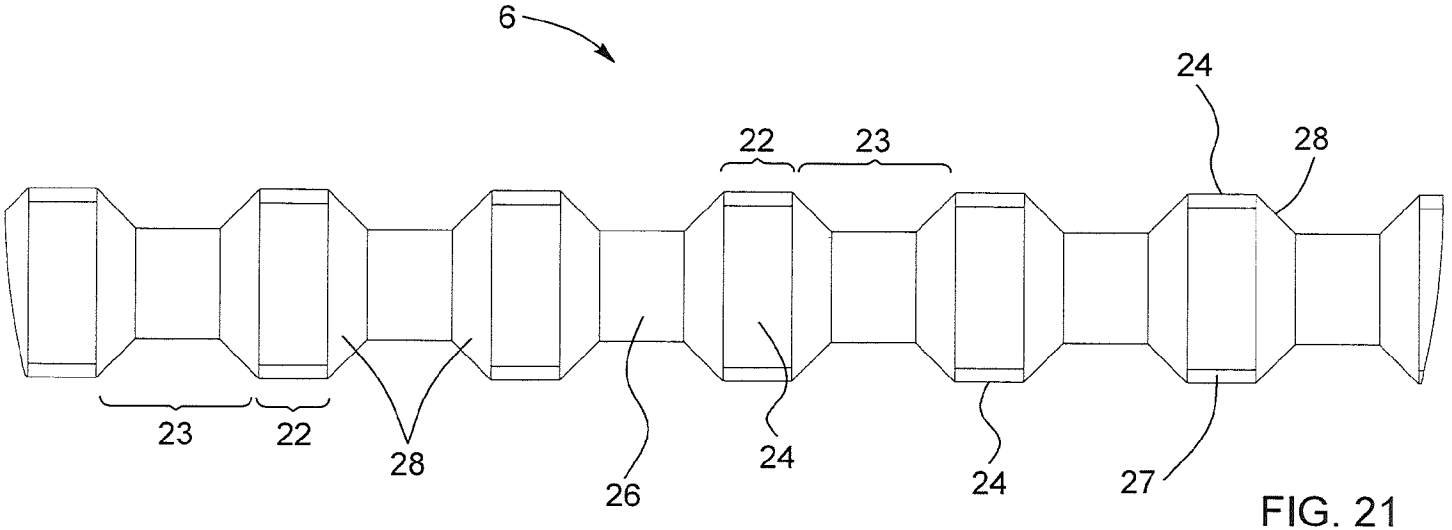
FIG. 21 is a side plan view of a part of a contact bar according to another embodiment of the present invention.
Figure 23:
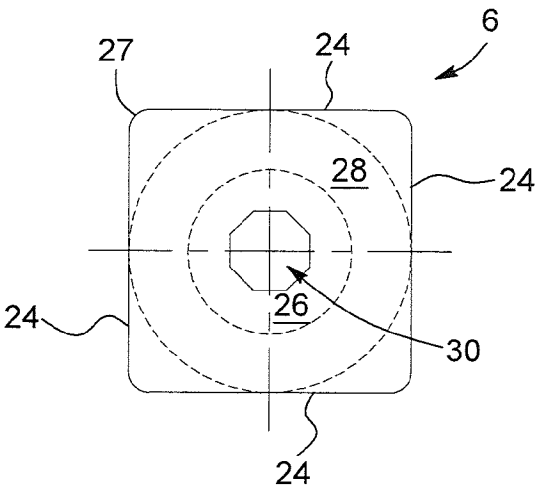
FIG. 23 is a front plan partially transparent view of FIG. 21 according to another embodiment of the present invention.
Figure 22:
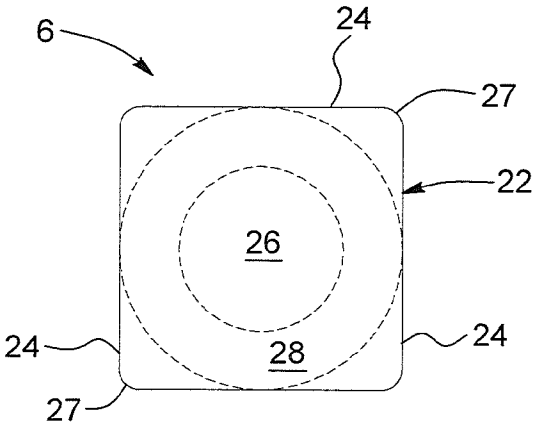
FIG. 22 is a front plan partially transparent view of FIG. 21.
Figure 24:
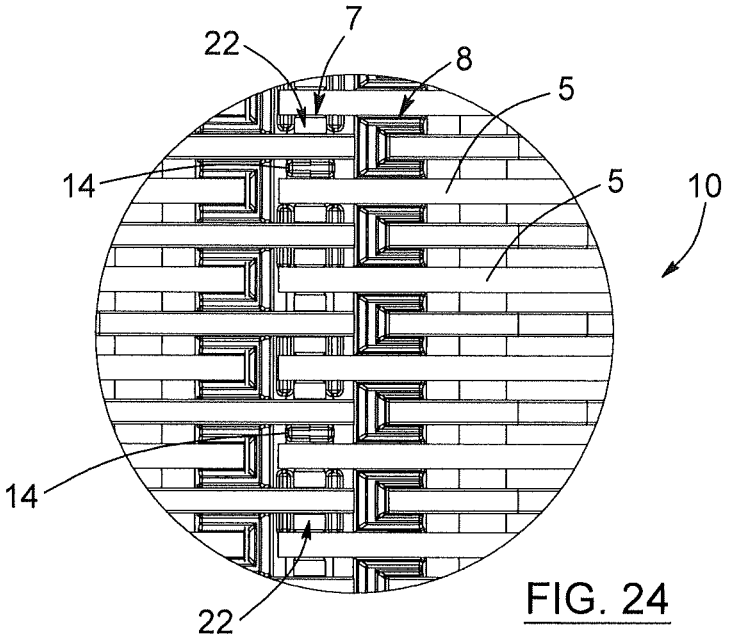
FIG. 24 is a close-up view of area VI of FIG. 5 according to another embodiment of the present invention.

As better seen in FIGS. 9, 14 and 20, the capping board 8 includes a main elongated body and two opposed rows of individual support seats 18 which project upwardly from a top surface of the capping board main body. The two rows of seats 18 are configured in a spaced and staggered relationship to each other. Each support seat 18 may have a top portion defining a recess 20 sized and configured to receive the hanging bar of an electrode (not shown in the FIGS. 9, 14 and 20). The two opposed rows of seats are spaced away from each other so as to form a central elongated channel in which the contact bar (or contact bar segment) may be positioned. According to an optional aspect of the capping board, adjacent seats in a row may be spaced away from one another so as to define corresponding lateral channels of the capping board. Hanging bars of the electrolytic cell therefore alternately rest on a seat or in a lateral channel of the capping board. Hanging bars positioned in the lateral channels thus bear onto the contact bar positioned in the central elongated channel of the capping board.

Referring to FIG. 14, each contact bar segment 7 includes a plurality of support sections 22 for providing support to the contact bar segments 7 laying on the capping board 8 and distribute weight of the hanging bars (not shown in FIG. 14) contacting with the contact bar segment 7 (or contact bar). Each support section 22 is spaced apart from the adjacent support section with a contact section 23 defining a recess therebetween for receiving one hanging bar of the electrodes.

Figure 15:
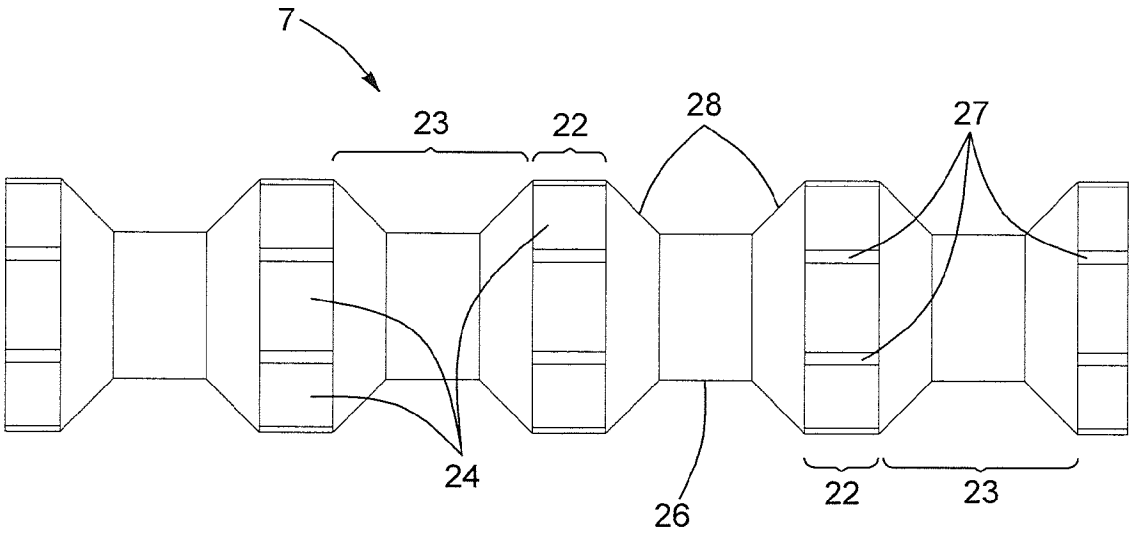
FIG. 15 is a side plan view of a part of a contact bar according to another embodiment of the present invention.
Figure 16:
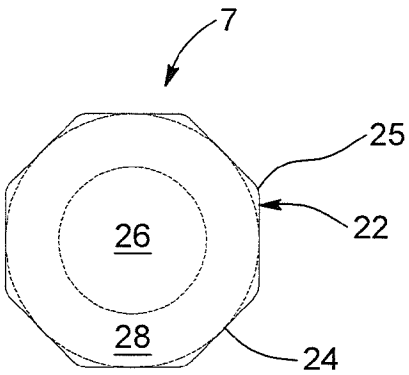
FIG. 16 is a front plan partially transparent view of FIG. 15.
Figure 17:
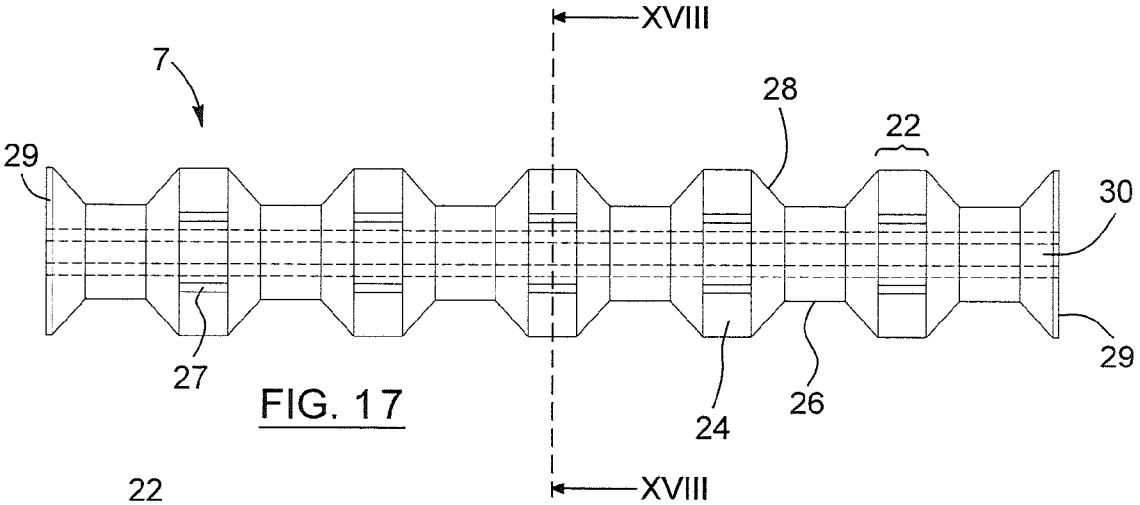
FIG. 17 is a side plan partially transparent view of a contact bar according to another embodiment of the present invention.
Figure 18:
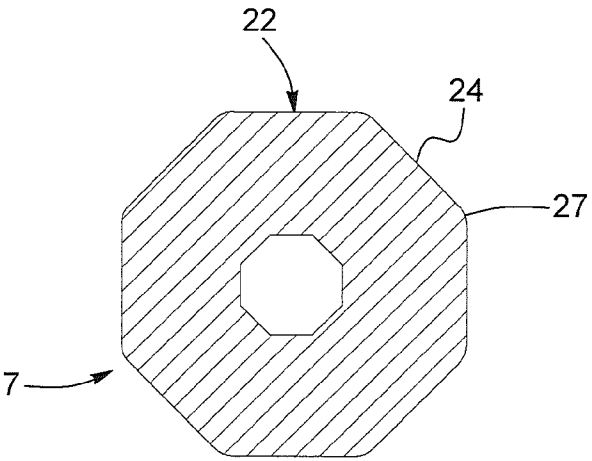
FIG. 18 is a cross-sectional view along line XVIII of FIG. 17.
Figure 19:
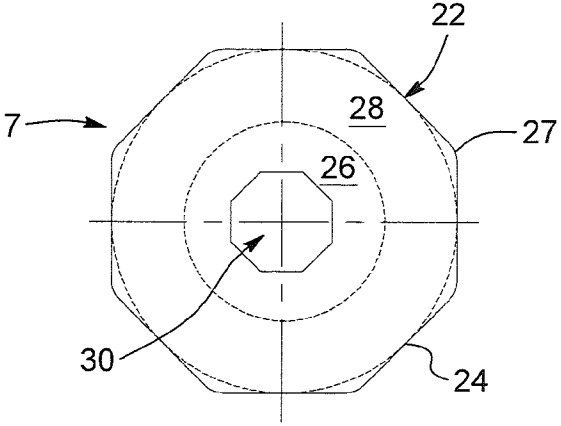
FIG. 19 is a front plan partially transparent view of FIG. 17.
Figure 42:
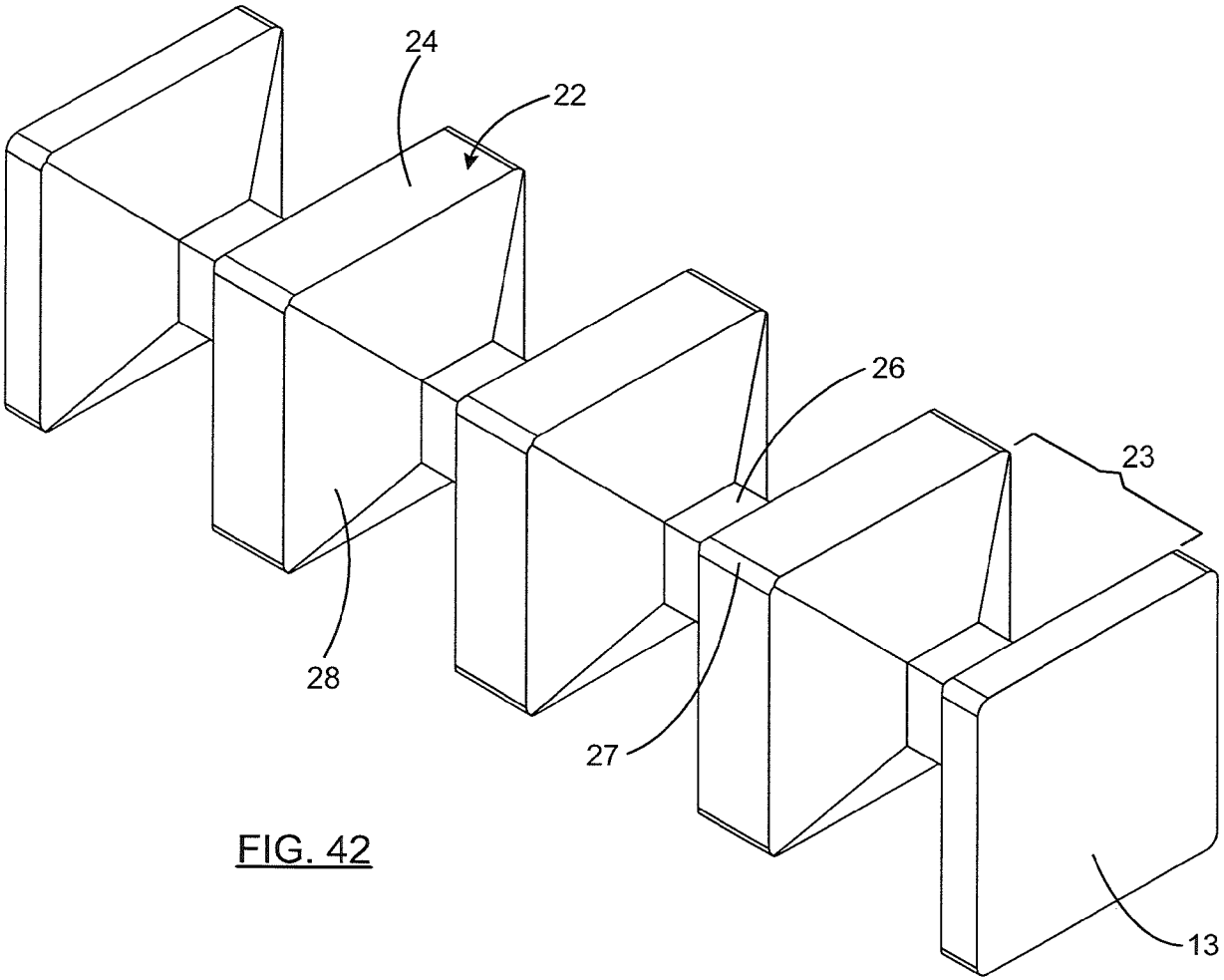
FIG. 42 is top perspective view of a contact bar segment according to another embodiment of the present invention.

Referring to FIGS. 15 and 16, each of the support sections 22 of the contact bar 6 (or contact bar segment 7) has multiple support surfaces 24. Each contact section 23 includes a central portion 26 in between two opposed tapered side portions 28. Each of the support sections 22 may be connected to the tapered side portions 28 which extend from either side of the support section 22 centrally toward the central portion 26 so as to form a V-shaped recess in between adjacent support sections 22. The central portions 26 and the tapered side portions 28 are located in between adjacent support sections 22 so as to form the overall contact bar 6 (or contact bar segment 7). The side portions 28 may be frusto-conical and extend from proximate the support surfaces 24 to the corresponding central portion 26. As seen in FIG. 42, the side portions 28 may also include four tapered surfaces, each tapered surface extending from proximate a corresponding support surface 24 to the central portion 26. It should be understood that the geometry of the side portions 28 are not limited to the illustrated embodiments and may include various size and number of tapered surfaces without departing from the scope of the present invention. According to the geometry of the cross-sectional shape of the support section, the number of support surfaces may vary. For example, in FIG. 15, the support section 22 has an octagonal cross-sectional shape and therefore has eight support surfaces 24. At least one support surface of each support section is in contact with the capping board for providing support. A rotation of the contact bar enables to select the at least one support surface resting on the capping board. The contact bar has an enhanced durability by providing interchangeable multiple support surfaces. Optionally, the support sections 22 and end walls 13 may also have bevelled corners 27, which may facilitate rotation, maintenance, installation and user safety and security. The contact bar or contact bar segment provides both a large surface area for protecting the capping board and good electrical contact with the electrodes.

The contact bar may be provided with support sections that are sized and configured to provide large surface area in accordance with the weight to be placed on the insulating capping board. The length and width and cross-sectional shape of the support sections may thus be provided to achieve a given amount of pressure distribution.

According to an optional aspect, as shown in FIGS. 7 to 19 and 26 the cross-sectional shape of the support sections 22 may be octagonal, thus providing eight different support surfaces for lying on the insulating capping board. According to another optional aspect, as shown in FIGS. 20 to 25, 27 to 38 and 42, the cross-sectional shape of the support sections 22 may be square, thus providing four different support surfaces for lying on the insulating capping board. In other non-illustrated embodiments, the cross-sectional shape of each support section may be rectangular, pentagonal, hexagonal or another trapezoid, thus providing four, five, six or more different support surfaces for lying on the insulating capping board.

According to a preferred embodiment of the contact bar, the support sections are shaped such that their side facing support surfaces are substantially vertical while some other surfaces are substantially horizontally positioned relative to or on the capping board. This configuration simplifies the design and construction of the support walls of the capping board, i.e. where the support walls are substantially vertical to align with the side facing support surfaces. This can be achieved by providing support sections with a cross-sectional shape that is substantially symmetrical and having an even number of sides. In the case of an odd number of support surfaces, e.g. for a pentagone, heptagone, etc., the capping board may be is provided with a construction and configuration such that the side support walls are either quite high to ensure lateral support or are shaped to correspond to the side profile of the support sections. For example, support walls may have a V-shaped recess to receive the corner of a support section with an odd number of support surfaces. Alternatively, the support walls of the capping board could be constructed to have a similar or corresponding angle as the support surfaces.

Figure 7:
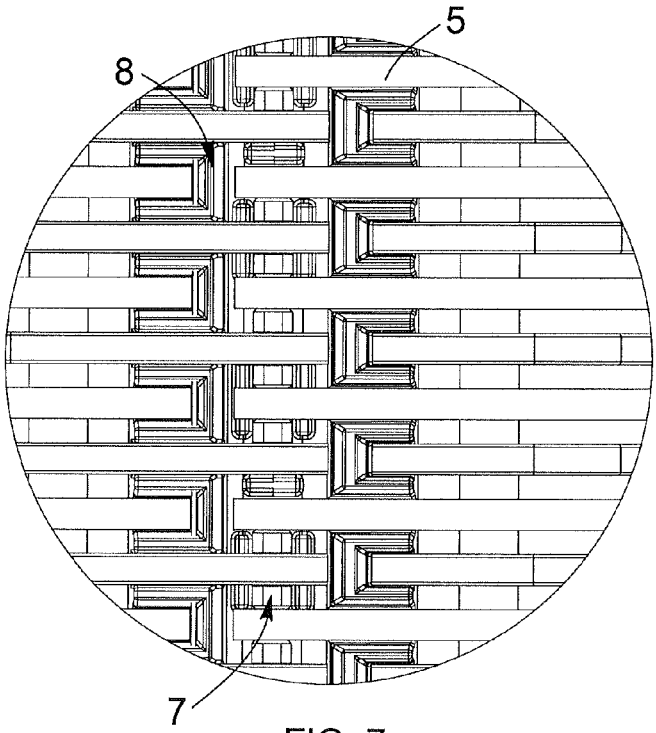
FIG. 7 is a close-up view of area VII of FIG. 5.

According to one aspect of the present invention, there is provided a method for operating an electrolytic cell including a contact bar resting on an insulating capping board as described herein above and herein below. The electrodes are positioned so as to span an electrolytic chamber of the electrolytic cell as better seen in FIGS. 5 and 6. Referring to FIG. 7, one hanging bar 5 of each electrode rests respectively on one of the contact sections of the contact bar 6 on one side of the chamber, and the other opposed hanging bar 5 rests on a part of the insulating capping board 8 on an opposed side of the chamber. The electrodes are therefore provided in an alternating arrangement along the electrolytic cell. More particularly, a first support surface of each support section of the contact bar may rest on the insulating capping board. The electrolytic cell is further operated by transmitting electrical current to the contact bar and the electrodes hanging thereon for refining the metal. After a period of time or after the contact sections may be damaged by hanging bars of the electrodes, one may rotate the contact bar such that a second support surface adjacent to the first support surface may rest on the capping board. The first support surface therefore no longer rests on the insulating capping board. This rotation enables to keep a good electrical contact between the contact bar and hanging bars of the electrodes by providing new parts of the contact sections which have not been damaged by the hanging bars or for any other reasons.

The contact bar or contact bar segment of the present invention thus advantageously provides multiple support surfaces for lying against insulating capping boards which distributes weight, reduces pressure and prolongs the lifetime of the capping board. The contact bars may be used multiple times before replacement by rotation to contact another of the support surfaces of the support sections. This construction provides a long lifetime for the contact bar. Furthermore, the contact bar according to the present invention provides high precision for the positioning of the electrodes to enable an even distribution of the density of the electric current, which is very important to regulate the plating of the refined metals.

Referring to FIGS. 17 to 19 and 23, each contact bar segment 7 may have a hollow axial passage 30 extending along its length. This hollow passage may optionally receive a rod (not illustrated in the Figs.) made of an insulating material for joining the contact bar segments 7 together while electrically insulating them from each other. The passage 30 illustrated in FIGS. 17 to 19 and 23 has an octagonal cross-sectional shape. In the case of contact bar segments provided with the insulating rod, the capping board may be provided without the transverse spacing walls for defining the space between contact bar segments. The contact bar segment may also include an insulating rod threaded through the adjacent spacing walls of the capping board.

It should be understood that the cross-sectional shape of the hollow passage and corresponding rod are not limited by the optional embodiments illustrated in the Figs. and may include various geometries such as circular, square and hexagonal cross-sectional shape. Furthermore, the cross-sectional shape of hollow passage may be the same or different from the cross-sectional shape of the corresponding support sections of the contact bar.

Figure 25:
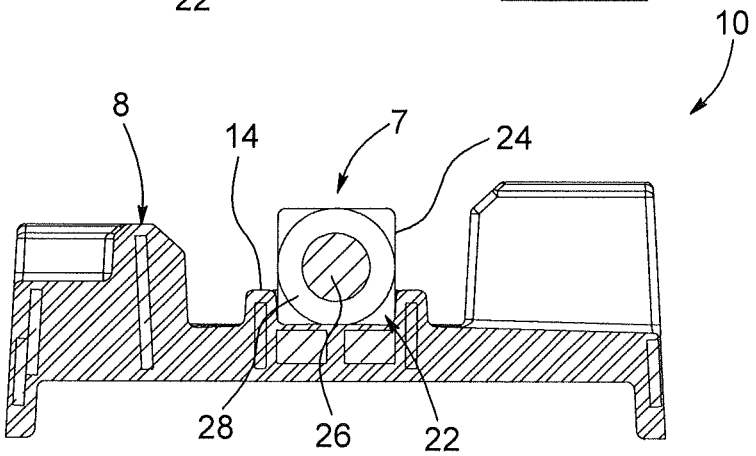
FIG. 25 is a cross-sectional view along line XXV of FIG. 20.
Figure 26:
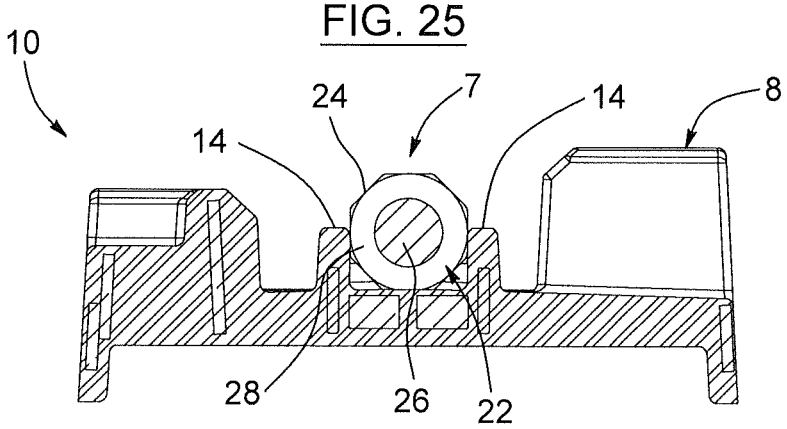
FIG. 26 is a cross-sectional view along line X of FIG. 9 according to another embodiment of the present invention.
Figure 27:
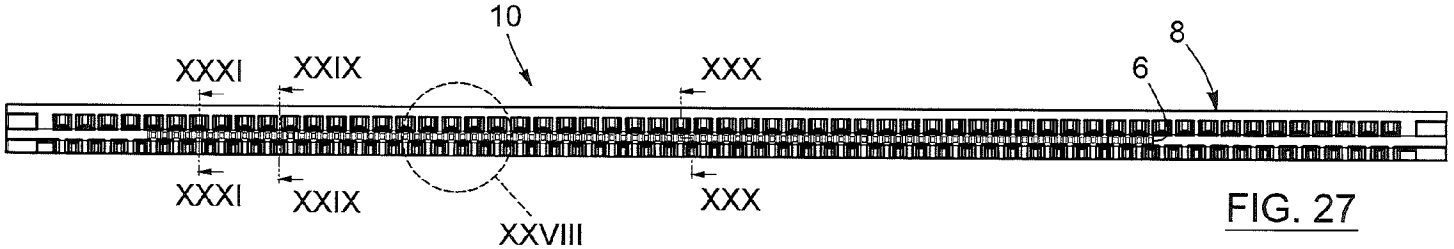
FIG. 27 is a top plan view of a contact bar and capping board assembly according to another embodiment of the present invention.
Figure 29:
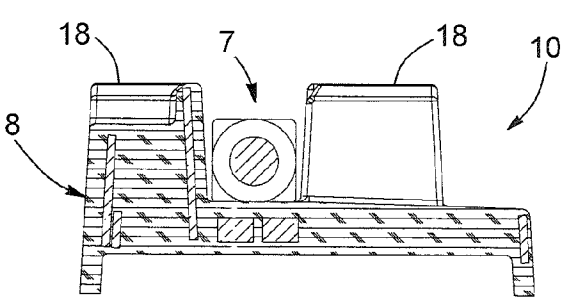
FIG. 29 is a cross-sectional view along line XXIX of FIG. 27.
Figure 31:
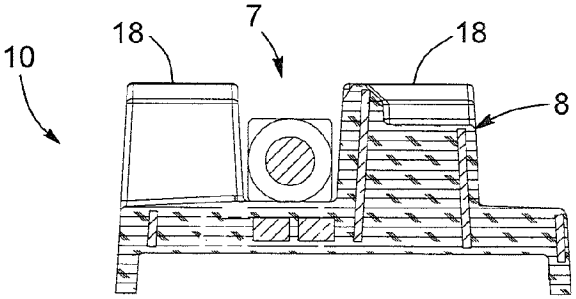
FIG. 31 is a cross-sectional view along line XXXI of FIG. 27.
Figure 28:
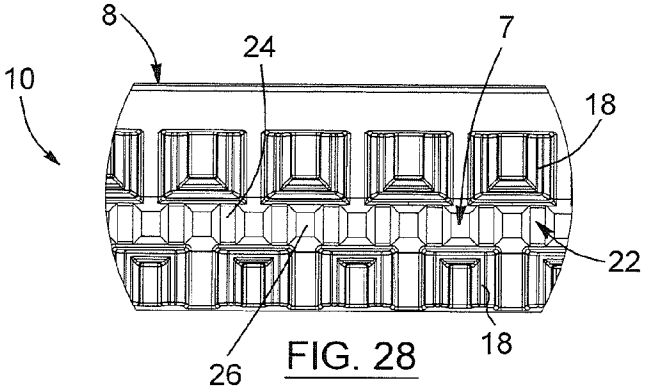
FIG. 28 is a close-up view of area XXVIII of FIG. 27.
Figure 30:
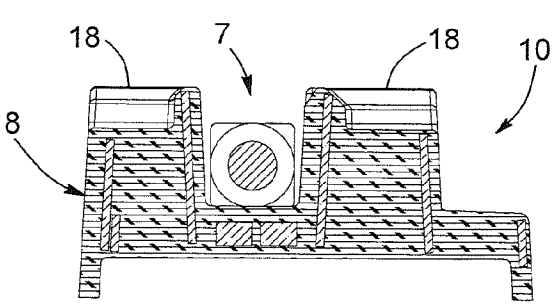
FIG. 30 is a cross-sectional view along line XXX of FIG. 27.
Figure 32:
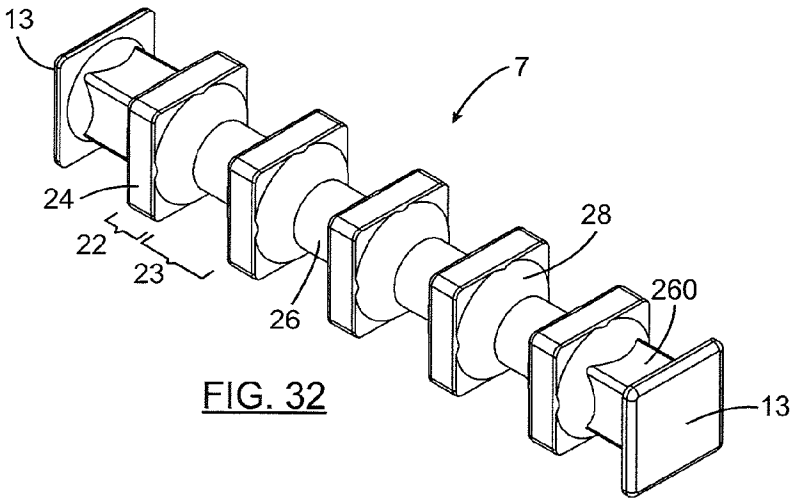
FIG. 32 is a top perspective view of a contact bar according to another embodiment of the present invention.

As already above-mentioned, support walls and spacing walls may have a variety of configurations and constructions depending on the shape and arrangement of the contact bar or contact bar segments. For example, FIG. 25 illustrates a short version of support walls 12 adapted to support sections 22 having a square cross-sectional shape. Additionally, FIG. 26 is a cross-sectional view of the contact bar and capping board assembly representing an alternative to FIG. 10 with higher support walls 16 which extend sufficiently high to ensure lateral support of the side facing support surfaces 24 of the support sections 22.

According to another optional aspect, the two opposed rows of support seats of the capping board may be spaced apart such that inner opposed surfaces of the seats provide support to the contact bar. Referring to FIGS. 27 to 31, the central elongated channel defined between the two rows of support seats 18 may be sized and shaped in accordance with the contact bar segment 7 (or contact bar). The opposed inner vertical surfaces of the support seats 18 function as support side walls for side facing support surfaces of the contact bar segments 7. The central elongated channel may be sufficiently wide to enable sliding of the contact bar into the channel, and sufficiently narrow to provide support to the side facing support surface of the contact bar.

According to one optional aspect, as shown in FIGS. 9 to 31, the central portion of the contact bar or contact bar segment may have a circular cross-sectional shape. It should be understood that the geometry of the cross-sectional shape of the central portion is not limited to the embodiments illustrated in the Figs. and may take various alternatives, such as square, rectangular, hexagonal, etc.

According to another optional aspect, the central portions located at the extremities of the contact bar or contact bar segment may be referred to as end central portions. Each contact bar or contact bar segment includes two opposed end central portions and one or more inner central portions, the number of inner central portions depending on the length of the contact bar or contact bar segment. The two end central portions and the inner central portions may have different or same cross-sectional shape. The end central portions may include at least one planar surface which rests on a corresponding seat of the capping board for better distributing weight pressure of the electrodes thereon. This configuration further reduces the mechanical stress endured by the insulating capping board.

Figure 34:
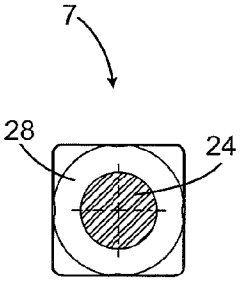
FIG. 34 is a cross-sectional view along line XXXIV of FIG. 33.
Figure 35:
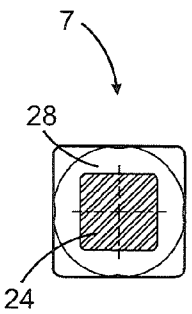
FIG. 35 is a cross-sectional view along line XXXV of FIG. 33.
Figure 33:
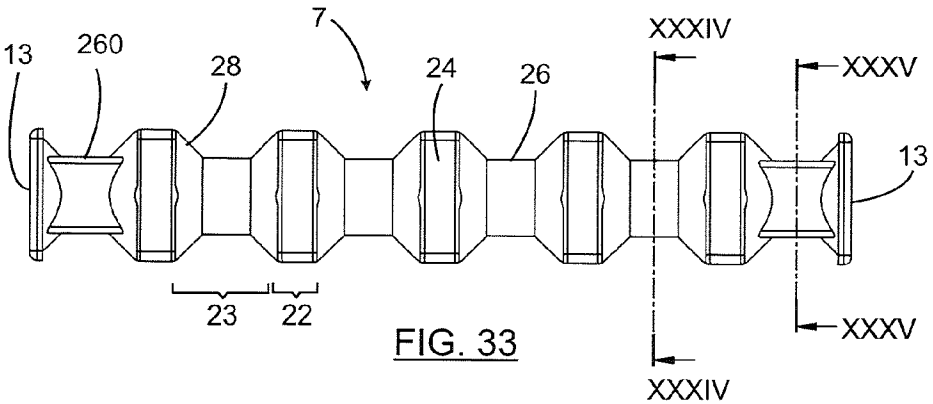
FIG. 33 is a side plan view of the contact bar of FIG. 32.

According to another optional aspect, referring to FIGS. 32 to 35, the contact bar segment 7 may include two end central portions 260 having a square cross-sectional shape (as better seen in FIG. 35) and inner central portions 26 having a circular cross-sectional shape (as better seen in FIG. 34). Each end central portion 260 thus includes four planar surfaces: a bottom planar surface that may rest on a corresponding seat 261 of the capping board (illustrated in FIG. 40), a top planar surface and two opposed side planar surfaces. These planar surfaces increase the mechanical resistance of the contact bar segment 7 while the hanging bars of the electrodes (not shown in FIGS. 32 to 35) lays on the frusto-conical tapered contact portions 28 of the contact bar segment 7. The square cross-sectional shape of the end central portions 260 enables an even distribution of the pressure exerted by hanging bars and by the contact bar on the capping board.

Figure 36:
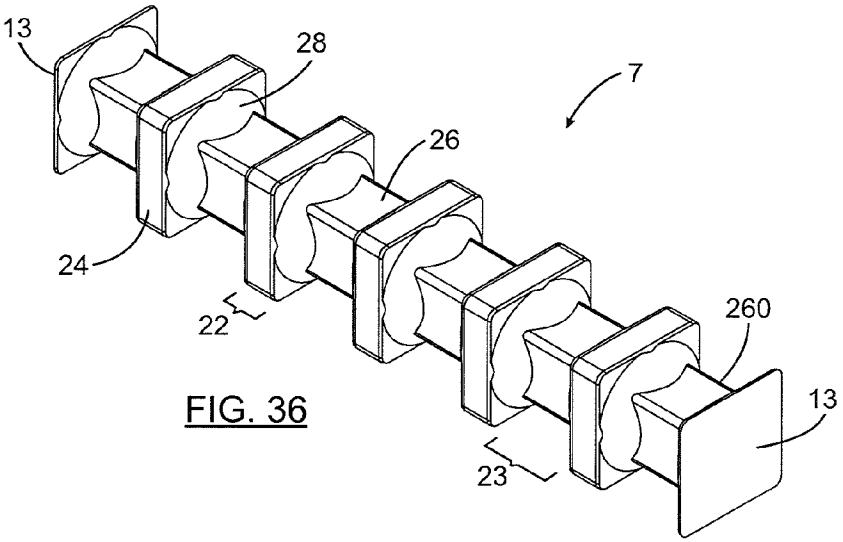
FIG. 36 is a top perspective view of a contact bar according to another embodiment of the present invention.
Figure 38:
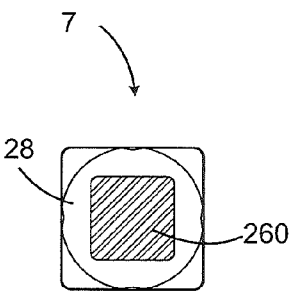
FIG. 38 is cross-sectional view along line XXXVIII of FIG. 37.
Figure 37:
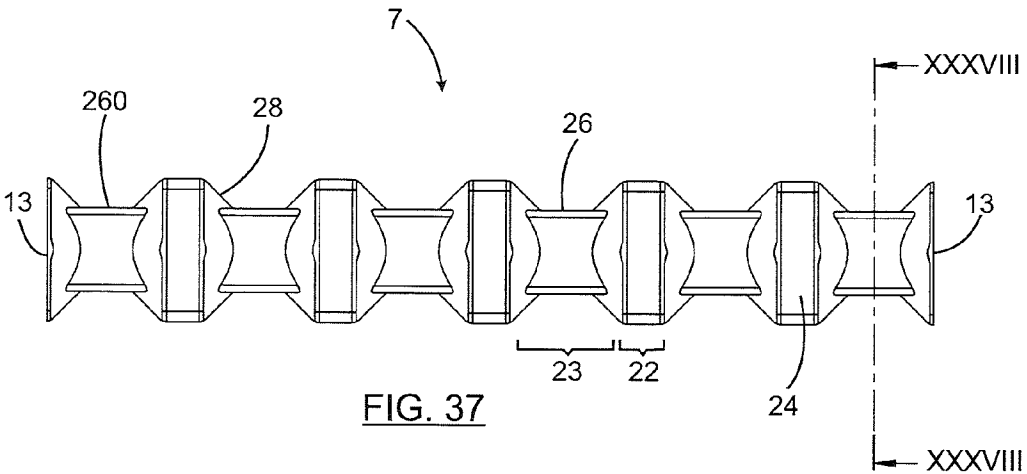
FIG. 37 is a side plan view of the contact bar of FIG. 36.

According to another optional aspect, each central portion of the contact bar or contact bar segment may have a square cross-sectional shape. Referring to FIGS. 36 to 38, the contact bar segment 7 includes two end central portions 260 and inner central portions 26 having a square cross-sectional surface, which may be parallel to the top support surface 24 of each support section 22. Inner central portions and end central portions may have advantageously the same cross-sectional shape for simplifying the manufacture of the contact bar or contact bar segment.

Figure 39:
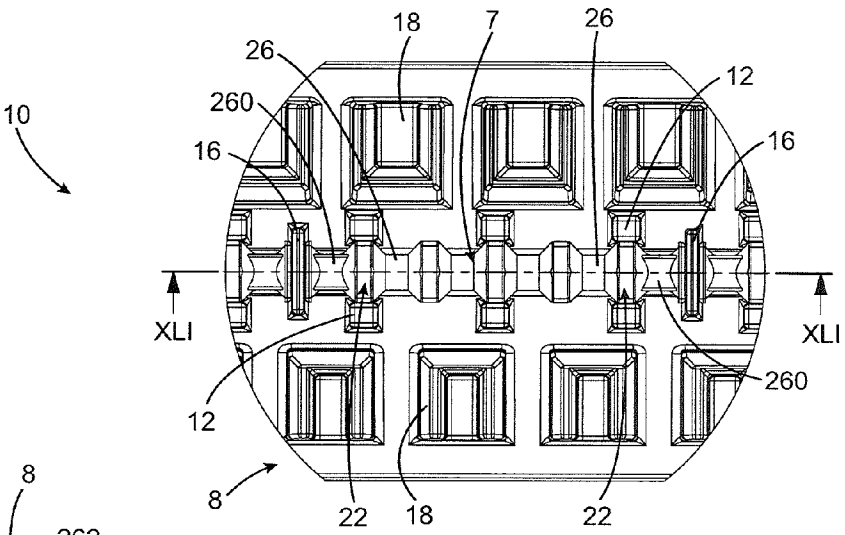
FIG. 39 is a top plan view of a part of a contact bar and capping board assembly according to another embodiment of the present invention.
Figure 40:
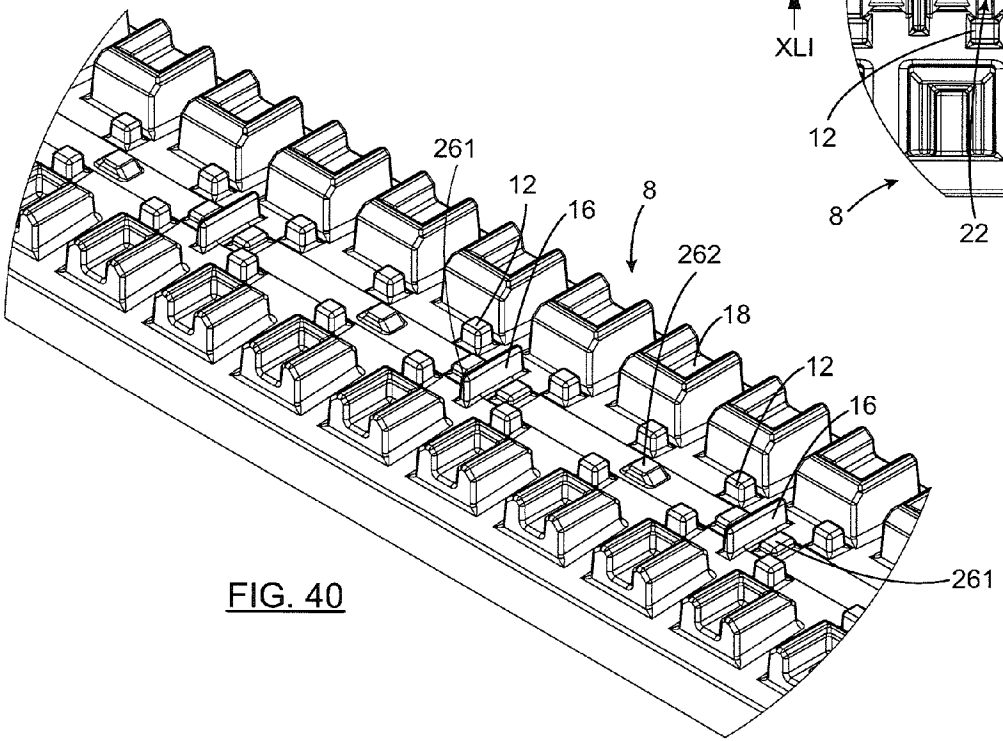
FIG. 40 is a top perspective view of a capping board according to another embodiment of the present invention.
Figure 41:
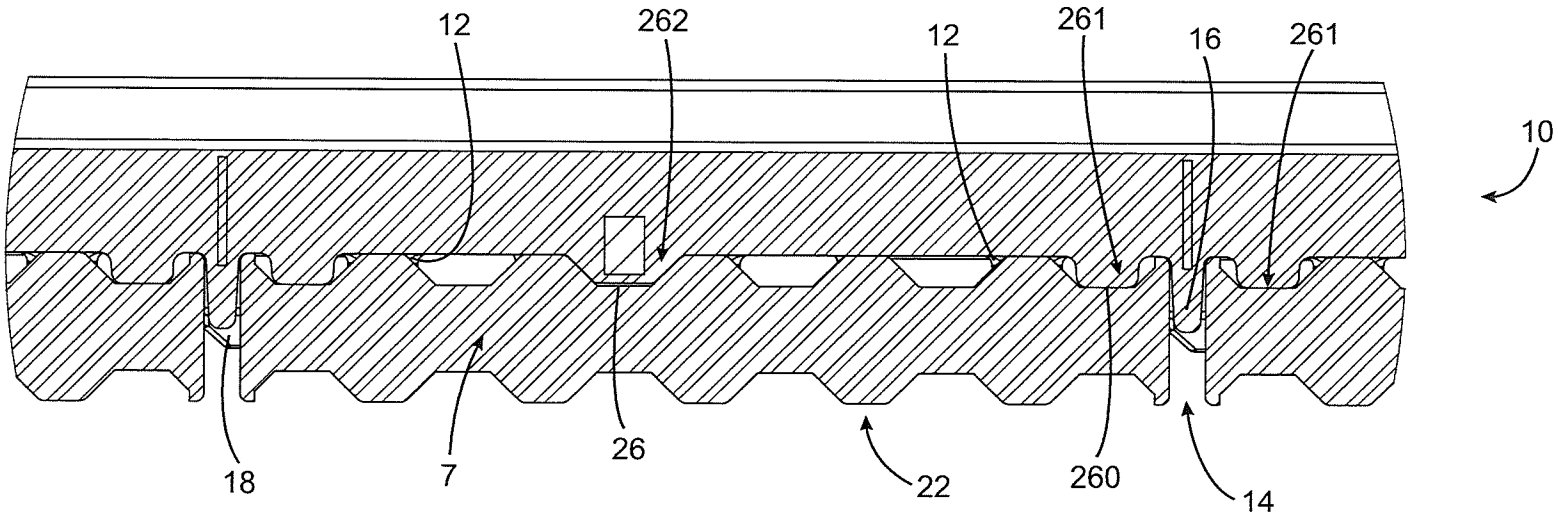
FIG. 41 is cross-sectional view along line XLI of FIG. 39.

According to another optional aspect, corresponding seats in the capping board may support at least the two end central portions of the contact bar. Referring to FIGS. 39 to 41, the capping board may include two opposed rows of support walls 12 sized and shaped to maintain some of the support sections 22 of the contact bar segment 7. The support walls 12 shown in FIGS. 39 to 41 are narrower than the ones shown in FIG. 9 for example, so as to maintain only one support section 22 per support wall 12, instead of several support sections. Referring to FIG. 40, for supporting each contact bar segment, the capping board also include two seats 261 receiving the at least one planar surface of the two end central portions 260, and one central seat 262 receiving one inner central portion centrally located with respect to the length of the contact bar segment. As better seen in FIG. 41, spacing walls 16 separate the adjacent contact bar segments 7; support walls 14 support side facing surfaces of the support sections 22; seats 261 support the end central portions 260 of each contact bar segment 7; and a central seat 262 support one inner central portion 36 centrally located in the contact bar segment 7. According to an optional aspect, the capping board may include seats for supporting each central portion of a contact bar segment for ensuring or maximizing an even repartition of the pressure exerted by the contact bar on the capping board in response to the weight of the electrode's hanging bar.

FIGS. 7 to 19 and 26 illustrate a contact bar segment provided with support sections having an octagonal cross-sectional shape. FIGS. 20 to 25, 27 to 38, 40, 41 and 43 to 45 illustrate a contact bar segment provided with support sections having a square cross-sectional shape. It should be understood that these support sections may also have a cross-sectional surface of various geometries including pentagonal, hexagonal, octagonal, etc. as long as it provides a flat surface for resting of the capping board and provide adequate distribution of the pressure exerted on the capping board.

According to another optional aspect, the contact bar or contact bar segment is made of conductive material which may be metallic material. The metallic material may include copper. According to an optional aspect, the volume of conductive material used to form the contact bar or contact bar segments is in accordance with the length of the capping board so as to ensure proper conduction of the electricity unto hanging bars located at extremities of the capping board.

According to another optional aspect, the contact bar or contact bar segment may be formed as a one-piece structure so as to avoid or reduce risks of breakage between support sections, tapered side portions and central portions.

According to another optional aspect, the contact bar or contact bar segment may have a length adapted to standard industrial insulating capping board and electrolytic cell. According to another optional aspect, the contact bar segment may include between three and five support sections.

According to another optional aspect, the capping board may be made from a plastic resin which may include polytetrafluoroethylene, acid resistant polyester, polyvinyl ester, epoxy, polyurethane, thermoset urethane, bisphenol-epoxy A - F fumarate polyester, acrylic terephtalate polyester, methacrylic terephtalate polyester, phenolic resins or any combination of such resins. Furthermore, the plastic resin of the capping board may include from 3 to 30% of glass fibres, from 2 to 10% of silica sand, from 1 to 30% mica, from 2 to 40% of silica rock, or any combination thereof in the form of particles. Optionally, the capping board may include from 2 to 40% of filler such as clay, talc, calcium carbonate and magnesium oxide, and from 0.1 to 5% of fumed silica. In practice, use may be made of an acid-resistant polyester resin because this resin is less expensive in addition of being easy to handle and providing good material stability.

According to another optional aspect, the capping board may also include at least one embedded pultruded bar. Optionally, the at least one pultruded bar may be embedded in the support seat and support walls of the capping board so as to provide enhanced rigidity and resistance to the capping board. Each of those pultruded bars may be obtained by pultrusion of fibres.

Of course, other modification could be made to the contact bar disclosed hereinabove without departing from the scope of the invention It should be understood that the invention is not limited to the above described and illustrated embodiments, but includes other embodiments to which many modifications and alterations may be made without departing from what has actually been invented in the present case, as broadly disclosed in the summary of the invention and the appended claims.

Even if the contact bar may be used in connection with a particular insulating capping board as illustrated in the Figs., the contact bar of the present invention may be used with a number of different types of insulators, which is not true of other known types of contact bars which are often limited to specific types of insulator constructions.

Finally, it should be understood that the present invention includes a contact bar, a contact bar segment, a contact bar and capping board assembly, a combination of multiple contact bar segments and an assembly of multiple contact bar segments and capping board. The present invention should not be limited to the embodiments described or illustrated herein.

The invention claimed is:

1. A contact bar segment for use in an electrolytic cell for resting on an insulating capping board and contacting electrodes to provide electrical contact therewith, the contact bar comprising:

a plurality of support sections, each support section comprising adjacent multiple support surfaces for resting on the insulating capping board and distributing weight; and a plurality of contact sections in an alternate configuration with the support sections, the contact sections defining recesses for receiving corresponding electrodes and providing electrical contact therewith;

wherein the contact bar segment is rotatable with respect to the insulating capping board so as to alternate the adjacent multiple support surfaces resting on the insulating capping board.

2. The contact bar segment according to claim 1, wherein each support section has a cross-sectional shape chosen so as to provide a number of support surfaces between 3 and 10.

3. The contact bar segment according to claim 2, wherein the number of support surfaces in each support section is 4, 6 or 8.

4. The contact bar segment according to claim 2, wherein the cross-sectional shape of each support section is square, rectangular, pentagonal, hexagonal, heptagonal, octagonal, nonagonal or decagonal.

5. The contact bar segment according to claim 1, wherein at least one support surface of each support section is contacting the insulating capping board for providing support to the contact bar segment.

6. The contact bar segment according to claim 1, wherein each contact section comprises two opposed side portions for contacting the electrode and a central portion located in between the two side portions to form the recesses in the contact bar segment.

7. The contact bar segment according to claim 6, wherein each side portion is tapered from proximate the support section inwardly toward the central portion of the contact section.

8. The contact bar segment according to claim 6, wherein each side portion is frusto-conical and extends from proximate the support surfaces of the adjacent support section to the central portion.

9. The contact bar segment according to claim 6, wherein the central portions comprise two opposed end central portions located at respective extremities of the contact bar segment and a plurality of inner central portions, each inner central portion being located in between two support sections of the contact bar segment.

10. The contact bar segment according to claim 9, wherein each end central portion is terminated by an end wall, the end wall having an edge contacting the insulating capping board.

11. The contact bar segment according to claim 10, wherein the end wall has a cross-sectional shape which is similar to the one of the support sections.

12. The contact bar segment according to claim 9, wherein each of the two opposed end central portions comprises at least one planar surface which is configured to rest on the insulating capping board for improving the distribution of a pressure exerted by the electrodes on the capping board.

13. The contact bar segment according to claim 9, wherein each of the two opposed end central portions has a square or rectangular cross-sectional shape.

14. The contact bar segment according to claim 1, wherein the multiple support surfaces have a size which corresponds to or is proportional to a weight of the electrodes hanging on the contact bar segment.

15. The contact bar segment according to claim 1, wherein the support sections comprise bevelled corners between each of the multiple support surfaces for facilitating rotation of the contact bar segment with respect to the insulating capping board.

16. The contact bar segment according to claim 1, wherein the contact bar segment is a one-piece structure.

17. A contact bar and capping board assembly for use in an electrolytic cell, the assembly comprising:

a plurality of adjacent contact bar segments, each contact bar segment being as defined in claim 1; and an insulating capping board comprising:

two opposed rows of support walls for laterally supporting side facing or vertical surfaces of the support sections of each contact bar segment, and two opposed rows of support seats, each support seat defining a recess for enabling a hanging bar of an electrode to rest thereon.

18. A contact bar and capping board assembly for use in an electrolytic cell, the assembly comprising:

an insulating capping board comprising:

two opposed rows of support seats in spaced apart relationship to each other for defining a central elongated channel, each support seat defining a recess for enabling an electrode to rest thereon; and at least one contact bar positionable along the central elongated channel, the at least one contact bar comprising:

a plurality of support sections, each support section comprising adjacent multiple support surfaces for resting on the capping board and distributing weight; and a plurality of contact sections in an alternate configuration with the support sections, each contact section comprising a recess for receiving another electrode and providing electrical contact therewith;

wherein the contact bar is rotatable with respect to the insulating capping board so as to alternate the adjacent multiple support surfaces resting on the insulating capping board.

19. The contact bar and capping board assembly according to claim 18, wherein each support section has a cross-sectional shape chosen so as to provide a number of support surfaces between 3 and 10.

20. The contact bar and capping board assembly according to claim 18, wherein at least one support surface of the multiple support surfaces of each support section is in contact with the insulating capping board for providing support to the at least one contact bar.

21. The contact bar and capping board assembly according to claim 18, wherein each contact section comprises two opposed side portions and a central portion located in between the side portions, each side portion being frusto-conical and extending from proximate the support surfaces to the central portion for defining a frusto-V-shaped recess for contacting the corresponding electrode.

22. The contact bar and capping board assembly according to claim 21, wherein the central portions comprise two opposed end central portions located at respective extremities of the at least one contact bar and a plurality of inner central portions, each inner central portion being located in between two support sections of the at least one contact bar.

23. The contact bar and capping board assembly according to claim 22, wherein each of the two opposed end central portions comprises at least one planar surface which is configured to rest on the insulating capping board for improving the distribution of a pressure exerted by each electrode on the capping board.

24. The contact bar and capping board assembly according to claim 23, wherein the insulating capping board comprises a plurality of seats sized and configured for supporting the at least one planar surface of the two opposed end central portions and at least one inner central portion resting thereon.

25. The contact bar and capping board assembly according to claim 18, wherein the central elongated channel of the insulating capping board is sized and shaped so as to contact inner side surfaces of the support seats of the capping board with side facing or vertical support surfaces of the at least one contact bar.

26. The contact bar and capping board assembly according to claim 18, wherein the capping board comprises two opposed rows of support walls projecting upwardly from the central elongated channel for supporting side facing or vertical support surfaces of the at least one contact bar.

27. The contact bar and capping board assembly according to claim 18, wherein the at least one contact bar is a first contact bar segment of multiple similar adjacent contact bar segments positionable in non-electrical contact relation with respect to one another.

28. The contact bar and capping board assembly according to claim 27, wherein each contact bar segment comprise a hollow passage centrally threaded along a length of the contact bar segment.

29. The contact bar and capping board assembly according to claim 28, comprising an insulating rod located into the hollow passage for structurally joining together the multiple contact bar segments while ensuring insulation therebetween.

30. The contact bar and capping board assembly according to claim 27, wherein the insulating capping board comprises spacing walls projecting upwardly from the central elongated channel for spacing the multiple adjacent contact bar segments resting along the central elongated channel of the capping board.

31. A method for operating an electrolytic cell comprising electrodes for refining metal, the method comprising the steps of:

(a) providing a contact bar and capping board assembly as defined in claim 18, a first support surface of each support section of the contact bar resting on the insulating capping board;

(b) positioning each electrode so as to span an electrolytic chamber of the cell and such that two opposed hanging bars of each electrode rest respectively on one of the contact sections on one side of the chamber and a part of the insulating capping board on an opposed side of the chamber, the electrodes being provided in an alternating arrangement along the electrolytic cell;

(c) transmitting electrical current to the contact bar and the electrodes hanging thereon for refining the metal; and (d) after a period of time, rotating the contact bar such that a second support surface adjacent to the first support surface is resting on the capping board, the first support surface thereby no longer resting on the insulating capping board.

32. The method according to claim 31, wherein the rotating of step (d) comprises lifting the hanging bars of the electrodes during rotation of the contact bar.

33. The method according to claim 31, wherein the rotating of step (d) is performed when electrical contact between at least one of the contact sections and a corresponding one of the electrodes is reduced or prevented.

34. The method according to claim 31, comprising repeating the rotating of step (d) a number of times in accordance with a number of the support surfaces of each support section of the contact bar.

35. The method according to claim 31, wherein the contact bar is one contact bar segment of multiple similar contact bar segments and wherein the rotating of step (d) is performed on at least one contact bar segment without rotating other contact bar segments.

36. The method according to claim 35, comprising replacing at least one contact bar segment while leaving other contact bar segments on the capping board.

* * * * *